United States Patent [19]

Toillié

[11] Patent Number: 4,736,549

[45] Date of Patent: Apr. 12, 1988

[54] ABRASIVE BELT WITH A JOINT EXTENDING TRANSVERSELY TO ITS LONGITUDINAL DIRECTION

[75] Inventor: Eberhard Toillié, Tornesch, Fed. Rep. of Germany

[73] Assignee: Norddeutsche Schleifmittel-Industrie Christiansen & Co (GmbH & Co), Hamburg, Fed. Rep. of Germany

[21] Appl. No.: 887,254

[22] Filed: Jul. 21, 1986

[30] Foreign Application Priority Data

Jul. 24, 1985 [DE] Fed. Rep. of Germany ..... 3526502

[51] Int. Cl.[4] ..... B24D 11/06

[52] U.S. Cl. ..... 51/399; 51/357; 51/400; 24/38

[58] Field of Search ..... 51/357, 394, 399, 400, 51/401, 404, 407, 381, DIG. 34; 24/38; 198/844, 846, 847; 428/60; 474/255, 256

[56] References Cited

U.S. PATENT DOCUMENTS

| | | | |
|---|---|---|---|
| 1,728,673 | 9/1929 | Driver | 51/399 |
| 3,729,873 | 5/1973 | Sandell | 51/399 |
| 4,215,516 | 8/1980 | Huschle et al. | 51/399 |
| 4,589,233 | 5/1986 | Parekh et al. | 51/399 |
| 4,606,154 | 8/1986 | Herrmann et al. | 51/401 |

FOREIGN PATENT DOCUMENTS

| | | |
|---|---|---|
| 0045408 | 5/1985 | European Pat. Off. . |
| 2333980 | 1/1977 | Fed. Rep. of Germany . |
| 928656 | 12/1947 | France . |

*Primary Examiner*—Robert P. Olszewski

*Attorney, Agent, or Firm*—Chilton, Alix & Van Kirk

[57] ABSTRACT

Abrasive belt with an abrasive-grain layer on a base containing a textile material, and with a joint extending transversely to its longitudinal direction. The latter contains a joining strip in a rebate on the side of the base facing away from the abrasive-grain layer. A set of parallel threads of the textile material extends transversely to the joint. To increase the quality of the joint, the textile material used is one in which the set of parallel threads forms a non-interwoven layer. This thread layer is arranged on the side of the textile material facing the abrasive-grain layer. This layer is held together by a further layer arranged on its side facing away from the abrasive-grain layer. Since the rebate is located in this further layer, the threads responsible for transmitting the longitudinal tensile forces and extending transversely to the joint remain unaffected.

8 Claims, 1 Drawing Sheet

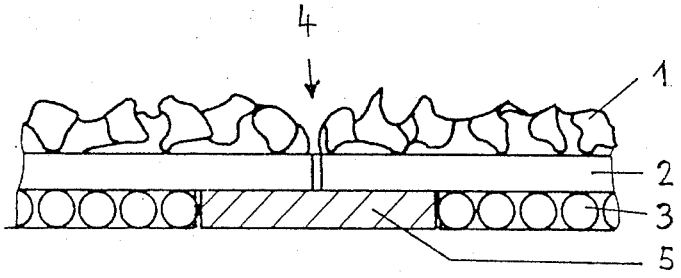
4
1
2
3
5

ABRASIVE BELT WITH A JOINT EXTENDING TRANSVERSELY TO ITS LONGITUDINAL DIRECTION

BACKGROUND OF THE INVENTION

The invention relates to an abrasive belt with an abrasive-grain layer on a base containing a textile material, and with a joint which extends transversely to its longitudinal direction and which contains a joining strip in a rebate on the side of the base facing away from the abrasive-grain layer, a set of parallel threads of the textile material extending transversely to the joint.

It is known to bridge the edges of an abrasive belt which are to be joined to one another, in the region of the joint, with a joining strip which is cast on the spot from hardened material in the rear rebate of the belt (U.S. Pat. No. 4,215,516) or which is prefabricated and cemented in (FR-PS 928,656). To make the rebate, part of the base including the woven fabric contained in it is removed so that the remaining part is weakened. Even if the rebate only extends over less than half the woven fabric thickness or if the rebate surfaces are inclined (U.S. Pat. No. 3,154,897), it is impossible to prevent the woven fabric threads extending transversely to the joint from being interrupted or at least weakened in those regions where, at a tying point, they pass through under the threads running transversely to them. To prevent this weakening the complete insertion of the joining strip in the rebate is often avoided but the disadvantage of this is that the joining strip projects above the belt surface on the rear side in a disturbing way.

SUMMARY OF THE INVENTION

The object on which the invention is based is, therefore, to provide an abrasive belt of the type mentioned in the introduction, in which the said weakening caused by the rebate of the joint is prevented or reduced.

In the solution according to the invention, the set of parallel threads extending transversely to the joint forms a non-interwoven layer which is located on the side of the textile material facing the abrasive-grain layer and which is held together by a further layer which is arranged on its side facing away from the abrasive-grain layer and in which the rebate for the adjoining strip is located.

The invention is based on the knowledge that, when a specific type of textile sheet-like structures known as such in abrasive belts is used (EP-PS 0,045,408, DE-PS 2,333,980), the layered arrangement of the various thread plies in the abrasive-belt base makes it possible to arrange that thread ply mainly responsible for transmitting longitudinal tensile forces in the abrasive belt in the base layer facing the abrasive-grain layer and provide the rebate for the abrasive belt-joint essentially in the other rear layer of the textile sheet-like structure, thereby completely or substantially protecting the thread ply responsible for transmitting the longitudinal tensile forces from weakening caused by the rebate.

Whilst, according to the invention, the textile material must always contain a layer which has threads extending transversely to the joint and which is responsible for transmitting the longitudinal tensile forces of the abrasive belt, there is considerable freedom in the selection of the layer which holds together the threads of the first-mentioned layer and which is arranged on the rear side of the latter. Preferably, however, this layer is also formed by a fibre material, preferably a set of threads extending transversely to the threads of the first-mentioned layer, and the layers can be joined by any means, but preferably in the manner of a stitch bonded fabric (such as is described, for example, in EP-PS 0,045,408 and the literature quoted in it).

In abrasive belts of normal width, the warp threads of a textile material, running in the longitudinal direction of the belt, can form the set of parallel threads; in this case only one joint is generally provided.

However, as regards a wide abrasive belt the width of which is greater than the production width of conventional textile webs used for the base, there is a plurality of joints, and the set of parallel threads extending transversely to the joints is formed by the weft threads of a textile material.

The statement that the threads responsible for transmitting the longitudinal tensile forces extend transversely to the joint serves merely to identify them but not to indicate a specific angle between these threads and the joint. In particular, there is no need for a right angle between these threads and the joint. Nor do these threads need to run exactly in the longitudinal direction of the abrasive belt.

The joint can have any shape. It does not necessarily have to be in a straight line, but, for example, can also be corrugated or serrated.

The rebate, in cross-section, can be limited at right angles by the joint. However, it can also extend obliquely in the form of a wedge or arcuately at each of the two edges to be joined. It appropriately has a cross-section which is constant in the longitudinal direction of the joint; however, the rebate can also be composed of a series of grooves which are arranged in succession and which extend in a longitudinal direction of the belt or in the longitudinal direction of the threads running transversely to the joint, as is known per se.

BRIEF DESCRIPTION OF THE DRAWING

The invention is explained in detail below with reference to the drawing which illustrates an advantageous exemplary embodiment in the form of a diagramatic cross-section through an abrasive-belt joint.

DESCRIPTION OF THE PREFERRED EMBODIMENT

The abrasive-grain layer 1 is carried by a flexible base which contains, as a supporting textile material, a stitch bonded fabric consisting of two layers, of which the upper layer located immediately below the abrasive-grain layer 1 contains a set of threads 2 extending approximately in the longitudinal direction of the abrasive belt, whilst the second layer lying underneath consists of threads 3 extending transversely to the threads 2. At 4, the abrasive belt contains a joint which extends transversely to its longitudinal direction and transversely to the drawing plane and which therefore also runs transversely to the direction of the threads 2. The connection is made by means of a joining strip 5 which is inserted into a rebate of the edges to be joined together on both sides of the joint. The depth of the rebate is equal to the thickness of the joining strip 5, so that the latter is contained completely in it. However, advantageously, this is not absolutely necessary in all cases.

The depth of the rebate is equal to the thickness of the layer formed by the threads 3, so that only the material belonging to this layer was removed when the rebate was made, whereas the layer formed by the threads 2 remains intact. The tensile forces can be transmitted directly from the threads 2 on one side of the joint to the joining strip 5 and from the latter to the threads 2 on the other side of the joint.

The invention results in a joint of high load-bearing capacity and reliability.

The design of the joining strip 5 and the technique for joining it to the abrasive belt can be of a known type.

I claim:

1. An abrasive belt with an abrasive-grain layer on a base containing a textile material, and with a joint which extends transversely to the longitudinal direction of the belt and which contains a joining strip in a rebate on the side of the base facing away from the abrasive-grain layer, a set of parallel threads of the textile material extending transversely to the joint, characterized in that the set of parallel threads (2) forms a non-interwoven layer which is located on the side of the textile material facing the abrasive-grain layer (1) and which is held together by a further layer (3) which is arranged on the side of the textile material facing away from the abrasive-grain layer and in which the rebate for the joining strip is located so that the layer of parallel threads remains intact.

2. Abrasive belt according to claim 1, characterized in that the textile material is formed by a stitch bonded fabric.

3. Abrasive belt according to claim 2, wherein the belt has only one joint, characterized in that the set of parallel threads (2) is formed by warp threads of the textile material which run through in the longitudinal direction.

4. Abrasive belt according to claim 2 wherein the belt is designed as a wide abrasive belt with a multiplicity of joints, characterized in that the set of parallel threads (2) extending transversely to the joint is formed by the weft threads of the textile material.

5. Abrasive belt according to claim 2, wherein the rebate has a depth substantially equal to the thickness of said further layer, and is formed by removal of material only from said further layer.

6. Abrasive belt according to claim 1, wherein the belt has only one joint, characterized in that the set of parallel threads (2) is formed by warp threads of the textile material which run through in the longitudinal direction.

7. Abrasive belt according to claim 1 wherein the belt is designed as a wide abrasive belt with a multiplicity of joints, characterized in that the set of parallel threads (2) extending transversely to the joint is formed by the weft threads of the textile material.

8. Abrasive belt according to claim 1, wherein the rebate has a depth substantially equal to the thickness of said further layer, and is formed by removal of material only from said further layer.

* * * * *